United States Patent [19]

Muller

[11] 4,243,143

[45] Jan. 6, 1981

[54] WRAPPER FOR A PLURALITY OF ARTICLES ARRANGED IN ROWS

[75] Inventor: Rolf Muller, Longuich, Fed. Rep. of Germany

[73] Assignee: The Mead Corporation, Dayton, Ohio

[21] Appl. No.: 20,103

[22] Filed: Mar. 12, 1979

[30] Foreign Application Priority Data

Mar. 11, 1978 [DE] Fed. Rep. of Germany ..... 2810564

[51] Int. Cl.[3] ..... B65D 65/00; B65D 75/00

[52] U.S. Cl. ..... 206/429; 229/40; 229/39 R

[58] Field of Search ..... 229/40, 52 A, 62, 35, 229/39 R; 206/434, 429, 1.5

[56] References Cited

U.S. PATENT DOCUMENTS 3,129,843 4/1964 Weiss ..... 229/40

3,508,699 4/1970 Graser ..... 229/40

3,874,034 4/1975 Clayton ..... 229/62

*Primary Examiner*—Joseph M. Moy

*Attorney, Agent, or Firm*—Erwin Doerr

[57] ABSTRACT

A wraparound carton with overlapping panels secured together by adjustable locking means to compensate for variations in the diameter of the articles to be wrapped. The locking arrangement comprises a locking tab struck from the outer lap panel and having a plurality of lateral projections along the side edges thereof so as to form wavy lines, and a locking aperture arranged in the underlying lap panel for receiving the locking tap therethrough and having side edges which converge toward the end edge of the associated lap panel. Also disclosed is a device for tightening the wrapper about the articles whereby the lap panels are pulled into overlapping relationship at a predetermined rate.

3 Claims, 5 Drawing Figures

WRAPPER FOR A PLURALITY OF ARTICLES ARRANGED IN ROWS

TECHNICAL FIELD

The invention relates to a wrapper for a plurality of articles such as bottles, cans, or the like, arranged in rows, consisting of a blank which forms a top wall, two side walls, and two bottom panels which can be combined into a bottom wall, which walls are interconnected by means of fold lines, with one bottom panel having locking tabs foldably joined thereto and adapted to engage in cooperating locking apertures in the other bottom panel and which may be supported in locked position by means of a retaining tab foldably joined to the edge of the locking apertures.

The articles to be packed in such wrappers ordinarily have approximately the same dimensions. In practice, however, the dimensional tolerances occurring within one individual package are relatively large. This is particularly true in the case of wrappers used for packaging multi-trip bottles, because numerous types of bottles which are similar but which do not have exactly the same dimensions are in circulation. The cause of this is not only manufacturing tolerances but especially also the fact that sufficient standardization of dimensions of the bottles has been lacking up to the present time. Even after the introduction of a standard for dimensions of the bottles, it is to be expected that bottles deviating from this standard will be in circulation for a long time and must be packaged in such wrappers.

The locking arrangement employed in these wrappers whereby locking tabs engage in locking apertures, require usually that the two bottom panels to be interlocked are brought together into a precisely pre-determined mutual position. This determines also the circumference of the wrapper.

In order to compensate for the tolerances, slits or weakened means have been provided, for example, at holding apertures for the articles to be packaged, which slits permit the holding apertures to enlarge when the force applied in locking the wrapper is too great because the articles are oversized. However, these measures for compensating for tolerances permit variations in dimensions only within a relatively small range. If larger fluctuations in dimensions occur, the danger arises that the wrapper will tear when being closed if the dimensions of the articles lie at the upper limit of tolerance or that the objects will fall out through the open end of the wrapper if the dimensions of the articles lie at the lower limit of tolerance.

BACKGROUND ART

From a wrapper of the above-mentioned type (U.S. Pat. No. 3,508,699), it is already known to provide compensation for tolerance variations by providing locking tabs having two lateral projections so that the two bottom panels can be joined together in two different relative positions whereby either one or the other lateral projection will engage with the edge of the locking aperture. However, even this step does not suffice for substantial enlargement of the permissible range of tolerance, because the two projections on each lateral edge of the locking tab have to be relatively close to each other. Otherwise the forward projections of the locking tab would prevent penetration into the locking aperture if the dimensions of the articles to be packaged are at the lower limit of tolerance, because in that case the entry of the forward portion of the locking tab is hindered by the lateral projections.

DISCLOSURE OF INVENTION

Therefore, it is the objective of the present invention to develop a wrapper of the above mentioned type in such a manner that, even in the case of the articles to be packed within a wide range of tolerances, compensation for tolerances is possible in the area of the lock so that the lock can be easily engaged in any possible position and will be secure.

In accordance with the invention, this objective is accomplished by providing the lateral edges of the locking tab over approximately their entire length with projections connected in a wavy line, and in that the lateral edges of the locking apertures diverge toward the edge at which the supporting tab is joined.

Because of the increasing size of the locking apertures, a relatively long locking tab, provided with projections over its entire length, can be introduced unhindered into the locking aperture. Therefore, the locking tab can be made as long as desired for the range of tolerances to be compensated. To lock the wrapper, it suffices to pull the two bottom panels together with a force commensurate to the strength of the wrapper and to lock the two bottom panels in the resulting relative position.

Further advantageous embodiments of the inventive concept are the subject matter of sub-claims.

The invention also relates to a device for producing the package whereby the particular objective is to design the device so that existing equipment can be modified with as small expense as possible in such a manner that it meets the requirements of the wrapper according to the invention.

BRIEF DESCRIPTION OF THE DRAWINGS

The invention will be explained in more detail below with reference to embodiments represented in the drawings wherein.

BEST MODE OF CARRYING OUT THE INVENTION

Figure 1:
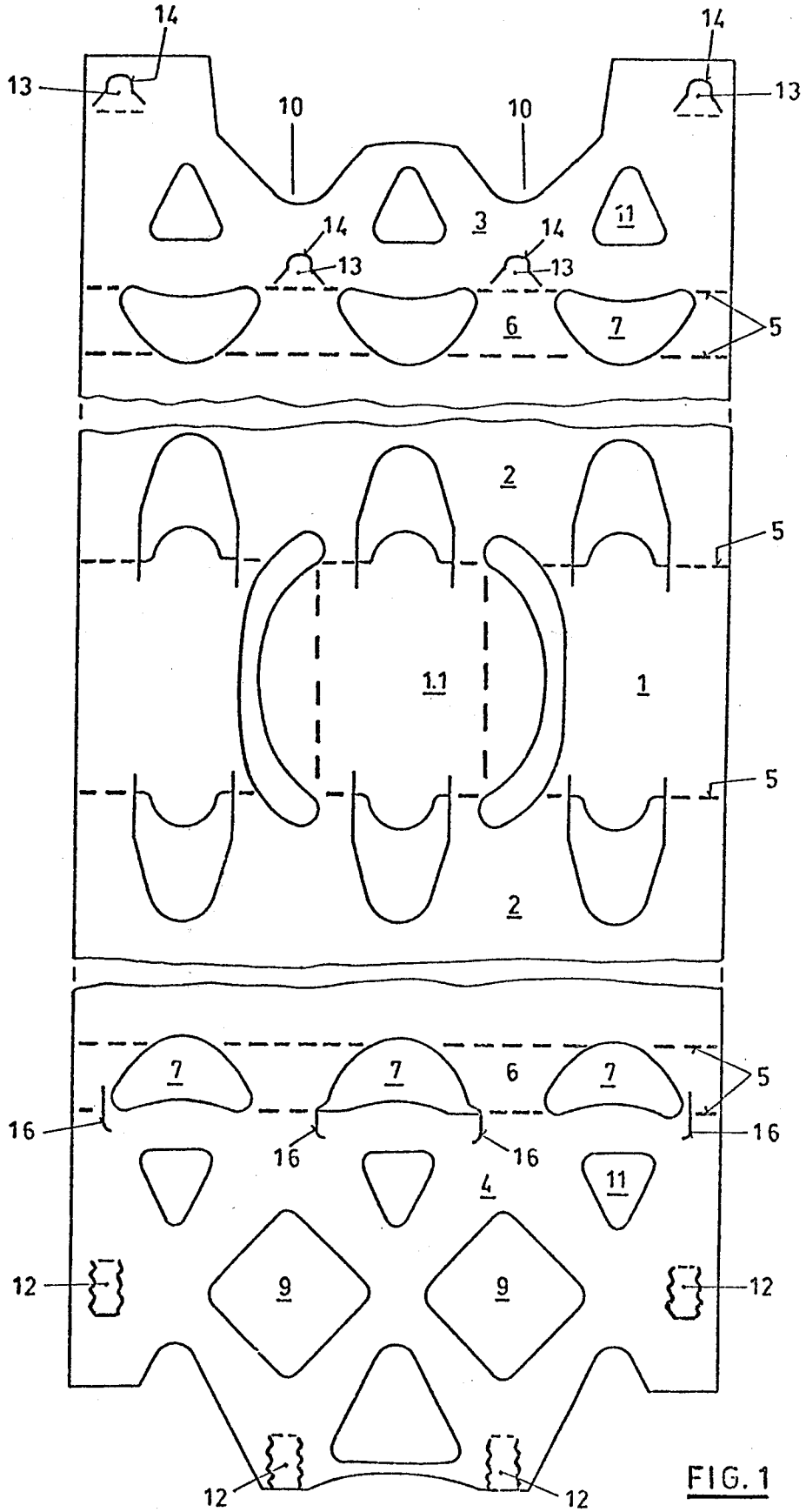
FIG. 1 shows a blank for a wrapper in accordance with the invention.

The blank for a wrapper as shown in FIG. 1 consists, by way of example, of pasteboard or paperboard and has a top wall 1 with a central portion 1.1 forming a carrying grip, two side walls 2, and two bottom panels 3 and 4 to be secured together into a bottom wall, which walls are joined together by means of fold lines 5, and including a panel 6 which has holding apertures 7 for the bottles 8 to be packaged (FIG. 3) and is disposed between the side walls 2 and the bottom panels 3 or 4. In the one bottom panel 4 there are provided apertures 9, which correspond to the cut-outs 10 in the other bottom panel 3, so that, when the wrapper is in the set-up condition, centering pins (not shown) of a pallet or the like can project between the bottles 8 into the wrapper for holding the package in place.

In addition, in the two bottom panels 3 and 4, there are provided approximately triangular tightening apertures 11, which serve for pulling the two bottom panels 3 and 4 toward each other before locking takes place.

Locking tabs 12 are struck from bottom panel 4 and are foldably connected at one end to the bottom panel 4. Supporting tabs 13 are struck at corresponding locations from the other bottom panel 3, so that locking apertures 14, having the form of the supporting tabs 13, are formed.

Figure 3:
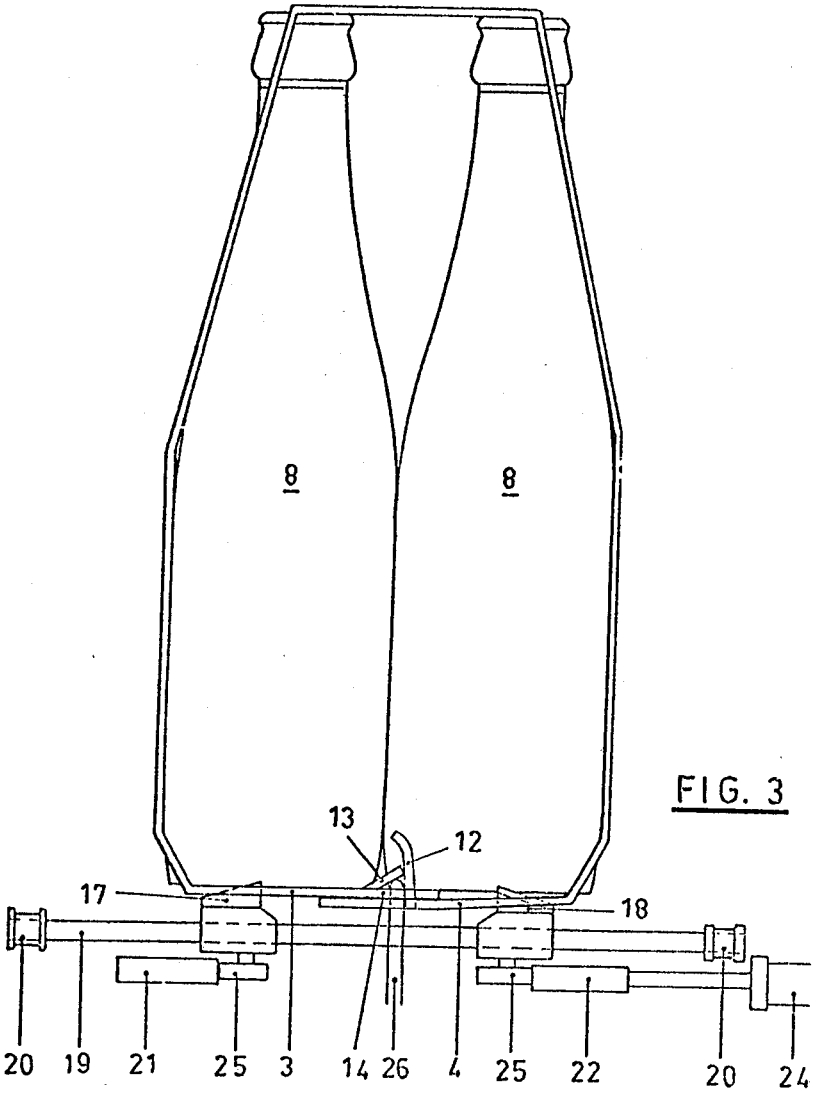
FIG. 3 shows, in a simplified vertical sectional view, a wrapper with bottles to be packaged positioned on an apparatus for locking the wrapper, whereby only a few parts of the apparatus are represented.
Figure 4:
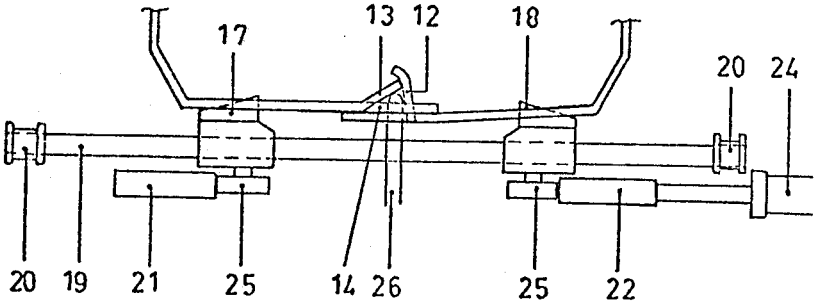
FIG. 4 shows, in partial representation according to FIG. 3, the parts of the apparatus and of the package in a situation where the dimensions lie at the upper limit of tolerance.

It is recognized from FIGS. 3 and 4 that, when the wrapper is in locked condition, the locking tabs 12 are folded upwardly into the locking apertures 14 and are supported in this locking position by the supporting tabs 13.

Figure 2:
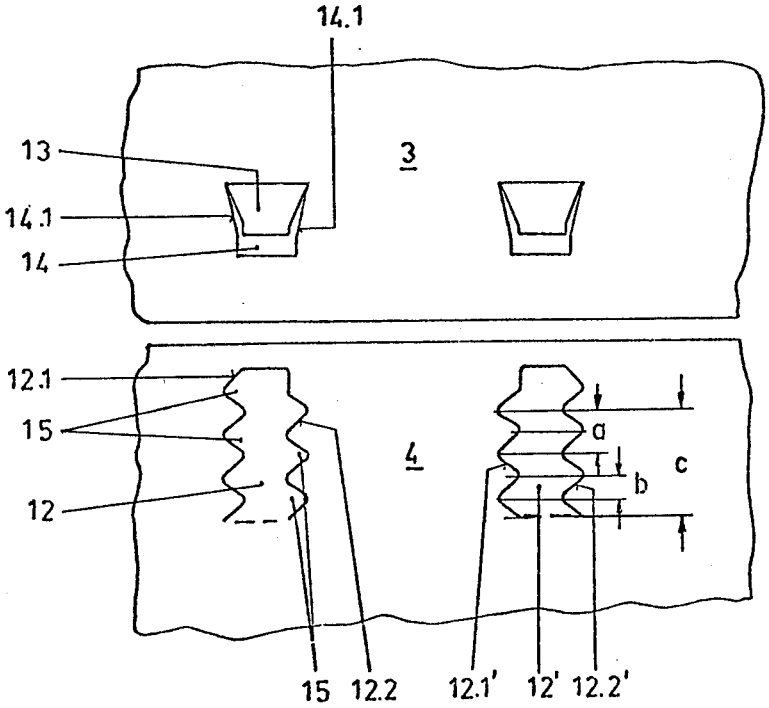
FIG. 2 shows details of the locking tabs and locking apertures in the bottom panels of the wrapper.

The special form of the locking tabs 12 and the locking apertures 14 may be recognized from FIG. 1 and particularly from FIG. 2. At their lateral edges 12.1 and 12.2, the locking tabs have projections 15, which are distributed over the entire length of the lateral edges 12.1 and 12.2 and thereby form wavy lines. The side edges 14.1 of the locking apertures 14 diverge toward the edge at which the supporting tab 13 is joined; they may have a short parallel portion at their other end, as can be clearly seen in FIG. 2.

The width of the locking apertures 14 is so chosen that the locking tab 12 can engage with one of the projections 15 behind the lateral edges 14.1 of the locking apertures 14. If, as shown in FIG. 3, the two bottom panels 3 and 4 overlap to a relatively great extent and consequently the locking tabs 12 have to extend far into the locking apertures 14, the projections 15 which are disposed at the forward position of the locking tab 12 do not prevent insertion of the locking tab 12, because the locking aperture 14 in this area is wider than on the side facing the locking tab 12. Therefore it is possible, in order to accommodate a very large range of tolerances, to make the length of the lateral edges 12.1 of the locking tab 12 which are provided with the projections 15, substantially greater than the lateral edge 14.1 of the locking apertures 14.

In the embodiment illustrated, it can be recognized, particularly from FIG. 2, that the wave lines formed by the projections 15 on the two lateral edges 12.1 and 12.2 of the locking tabs 12 run parallel to each other. The corresponding lateral edges 12.1' and 12.2' of an adjacent locking tab 12', likewise having wave lines, extend in mirror image fashion to the wavy lines of the lateral edges 12.1 and 12.2. The parallel course of the lateral edges 12.1 and 12.2 or 12.1' and 12.2' makes it possible that the distance for engagement of the locking tabs is not the same as the distance a between two adjacent projections 15 but rather amounts to only half the distance b, because one of the projections can engage alternatively on the left-hand lateral edge 12.1' or the right-hand lateral edge 12.2' of the locking tab 12'. However, the mirror-image arrangement of the lateral edges of adjacent locking tabs 12 or 12' prevents the locking tabs 12 and 12', whose width is the same at all points, from being pulled out of the locking apertures 14. The reduction of the engaging distance to the dimension b makes it possible to provide relatively large projections 15, even in the case of a small engaging spacing, so that the projections, even if the strength of the material is low, obtain a sufficient holding effect. The total range of tolerances is designated c.

In the area of the fold lines 5 between the bottom panel 4 and the one side wall 2, lateral cuts 16 are provided on the holding apertures 7 which receive and hold the bottom edges of the bottles 8; these cuts will tear if a predetermined pulling force on the blank is exceeded so that the respective holding aperture 7 becomes enlarged. In the case of the intermediate holding aperture 7, the two cuts 16 run from the bottom panel 4 into the holding aperture 7. These cuts 16 open up even with the use of relatively small force. In contrast, the cuts 16 at the two extreme holding apertures 7 run only to the outer side of the respective holding aperture 7 and not into the latter so that here great force is required to expand the retaining aperture 7. In this way, the outer bottles of the two rows of bottles are still retained securely within the wrapper even if the two middle bottles have relatively large diameters.

Enlargement of the intermediate holding apertures takes place even with a small pulling force and/or to a greater extent than in the case of the extreme holding apertures.

Figure 5:
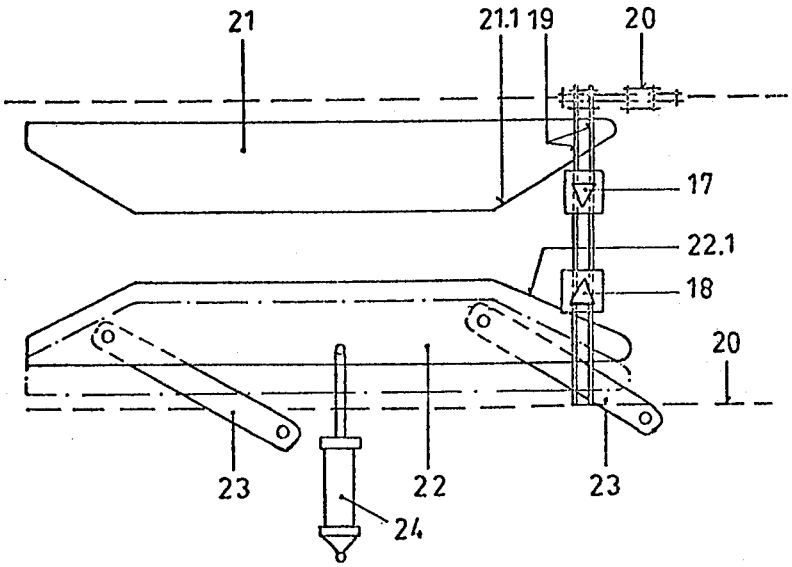
FIG. 5 shows a simplified plan view of the parts of the device shown in FIGS. 2 and 3.

The blank is secured by means of a device whose parts are shown in FIGS. 3, 4, and 5 in simplified form. Tightening hooks 17 and 18, which are yieldingly moved toward each other while the filled wrapper advances along the device, are inserted into the tightening apertures 11 (FIG. 1) provided in the two bottom panels 3 and 4. For this purpose, the pairs of opposing tightening hooks 17 and 18 are arranged to move on rods 19 which are connected at their ends to a link of a chain 20 (FIG. 5). The two chains 20 revolve continually and carry the filled wrapper with them. In this movement of the chains 20, which are shown in FIG. 5 in plan view, the tightening hooks 17 and 18, only one pair of which is illustrated, are moved along on guide rails 21, 22. One guide rail, 21, which lies on the side of the bottom panel 3 with the locking apertures 14, is fixedly mounted on the support whereas the other guide rail, 22, is moved in a parallel direction by means of guides 23 and is forced, by means of a pneumatic cylinder 24, yieldingly with a predetermined force, from the retracted position shown in FIG. 5 in dot-and-dash lines, into the position shown in solid lines. The guide rails 21 and 22 have bevels 21.1 and 22.1, over which guide rollers 25 connected to the tightening hooks 17 or 18, travel.

When the rollers 25 come into contact with the bevels 21.1 and 22.1, the tightening hooks 17 and 18 are moved toward one another, in order to tighten the wrapper around the bottles 8. Thereby, the tightening hook 17 moves necessarily into a position predetermined by the guide rail 21, so that the locking aperture 14 always arrives in a position in which a finger 26 can punch the locking tab 12 upwardly through the locking aperture 14. The tightener hook 18 is moved inwardly until a force predetermined by the pressure in the pneumatic cylinder 24 and corresponding to the desired maximum pulling force for the wrapper, is obtained. In this position, in which the wrapper has been tightened to the desired extent, the locking operation takes place.

The range of tolerances resulting when the wrapper is secured can be clearly seen from a comparison of FIGS. 3 and 4. FIG. 3 shows one tolerance limit wherein the bottles 8 to be wrapped lie at the lower limit of the possible dimensions. The two bottom panels 3 and 4 are moved toward each other until they overlap to a relatively large extent, and the locking tab 12 extends far upwardly. In contrast, the overlap in the case of the other tolerance limit (FIG. 4) that is, in the case of the greatest possible dimensions of the bottles to be wrapped, is smaller, and the locking tab 12 projects only slightly into the wrapper.

I claim:

1. A wrapper for a plurality of articles arranged in rows, such as bottles, cans or the like, comprising overlapping panels secured together by at least one locking tab struck from one of said panels and engageable in a correlated locking aperture provided in the other of said panels, said locking tab being provided with lateral projections along the entire length of the side edges thereof to form wavy lines and the side edges of said locking aperture diverging inwardly with respect to the end edge of said other panel, characterized in that said wavy lines along the side edges of said locking tab run parallel with respect to each other.

2. The wrapper in accordance with claim 1, further characterized in that the length of said locking tab is greater than that of said locking aperture.

3. The wrapper in accordance with claim 1, further characterized in that a retaining tab is joined to the inner edge of said locking aperture.

* * * * *